US009108094B2

(12) United States Patent
Cello

(10) Patent No.: US 9,108,094 B2
(45) Date of Patent: Aug. 18, 2015

(54) WATER DUMPING TARGET APPARATUS AND METHOD

(71) Applicant: Philip Craig Cello, Fairfield, CA (US)

(72) Inventor: Philip Craig Cello, Fairfield, CA (US)

( * ) Notice: Subject to any disclaimer, the term of this patent is extended or adjusted under 35 U.S.C. 154(b) by 0 days.

(21) Appl. No.: 14/214,189

(22) Filed: Mar. 14, 2014

(65) Prior Publication Data

US 2014/0265134 A1 Sep. 18, 2014

Related U.S. Application Data

(60) Provisional application No. 61/798,987, filed on Mar. 15, 2013.

(51) Int. Cl.

| | |
|---|---|
| ***F41J 5/22*** | (2006.01) |
| ***A63B 63/04*** | (2006.01) |
| ***A63B 63/00*** | (2006.01) |
| ***A63F 9/02*** | (2006.01) |
| *A63B 71/06* | (2006.01) |

(52) U.S. Cl.

CPC . *A63B 63/00* (2013.01); *A63F 9/02* (2013.01); *A63B 2071/0655* (2013.01); *A63F 2250/0421* (2013.01)

(58) Field of Classification Search

CPC ..... A63G 31/007; A63B 63/06; A63F 2250/0421

USPC ..... 472/128; 273/384–385; 182/20–21, 35

See application file for complete search history.

(56) References Cited

U.S. PATENT DOCUMENTS

| | | | | |
|---|---|---|---|---|
| 4,093,228 | A * | 6/1978 | Pierce | 273/384 |
| D334,044 | S * | 3/1993 | Lopatin | D21/811 |
| 5,634,642 | A * | 6/1997 | Grandolfo | 473/423 |
| 5,848,793 | A * | 12/1998 | Celis | 273/384 |
| 6,782,844 | B2 * | 8/2004 | Winney | 119/78 |
| 7,114,592 | B1 * | 10/2006 | Gibson et al. | 182/129 |
| 7,270,307 | B2 * | 9/2007 | Zodnik | 248/238 |
| 8,702,104 | B2 * | 4/2014 | Legary et al. | 273/384 |

OTHER PUBLICATIONS

Aquaventronics, Beat the Bucket brochure, http://www.aquaventronics.com/beatTheBucket/Aquaventronics_BeatTheBucket_Portable_Brochure.pdf, copyright 2011.* eHow, Homemade Carnival Dunk Game, http://www.ehow.com/how_6141483_homemade-carnival-dunk-game.html, captured Apr. 5, 2011.*

* cited by examiner

*Primary Examiner* — Melba Bumgarner
*Assistant Examiner* — Laura L Davison
(74) *Attorney, Agent, or Firm* — John C. Merchant

(57) ABSTRACT

A water dumping game apparatus and method for using the same. The apparatus consists of a water bucket type container with target adapted to be filled with water and hinged connected with a base. The base is configured for attachment with a support apparatus such as a ladder or standard having a horizontal member. The force of a projectile striking the target causes the hinge to pivot and tilt the container so as to dump water on a subject dousee positioned adjacent and below the container.

17 Claims, 3 Drawing Sheets

WATER DUMPING TARGET APPARATUS AND METHOD

FIELD OF INVENTION

This invention is directed to a water dumping game apparatus and method for using the same.

BACKGROUND

There are presently numerous amusement games involving a water dumping which utilizing a target which when struck by a projectile will cause a bucket of water to be dumped onto a participant. Such prior art apparatus generally consist of a bucket type container or other water receptacle (for example, a water balloon) mounted on a standard, a target mounted on a stationary or moveable arm member, and a release mechanism for causing water to be dumped on a subject participant positioned below the bucket. The force of a projectile (such as a ball, flying disk, or bean bag) striking the target located on the arm member activates the release mechanism. The prior art is generally overly large in size, complicated in construction, difficult to set up and use and expensive to manufacture and ship.

SUMMARY OF INVENTION

The invention is a water dumping apparatus that may be utilized with a variety of alternative dousing materials and method for using the same. It comprises an open top container configured for receiving water (or other dousing material), the container having or attached with a target. The container is connected with a base utilizing a hinge type connection, the base having means for attachment with a support apparatus such as a standard sized ladder. The support apparatus is positioned between a participant (i.e. the subject dousee) and other participants (i.e. dousors) who attempt to cause a projectile to strike the target causing the container to tilt or rotate backward on the hinge axis causing the water to be dumped downward onto the subject participant below. A shielding device, such as a cover mounted on or with the support apparatus, may be utilized to protect the subject dousee from being it by a projectile aimed at the target. A tube connected with the container may be utilized to fill the container with water.

DETAILED DESCRIPTION

Figure 1:
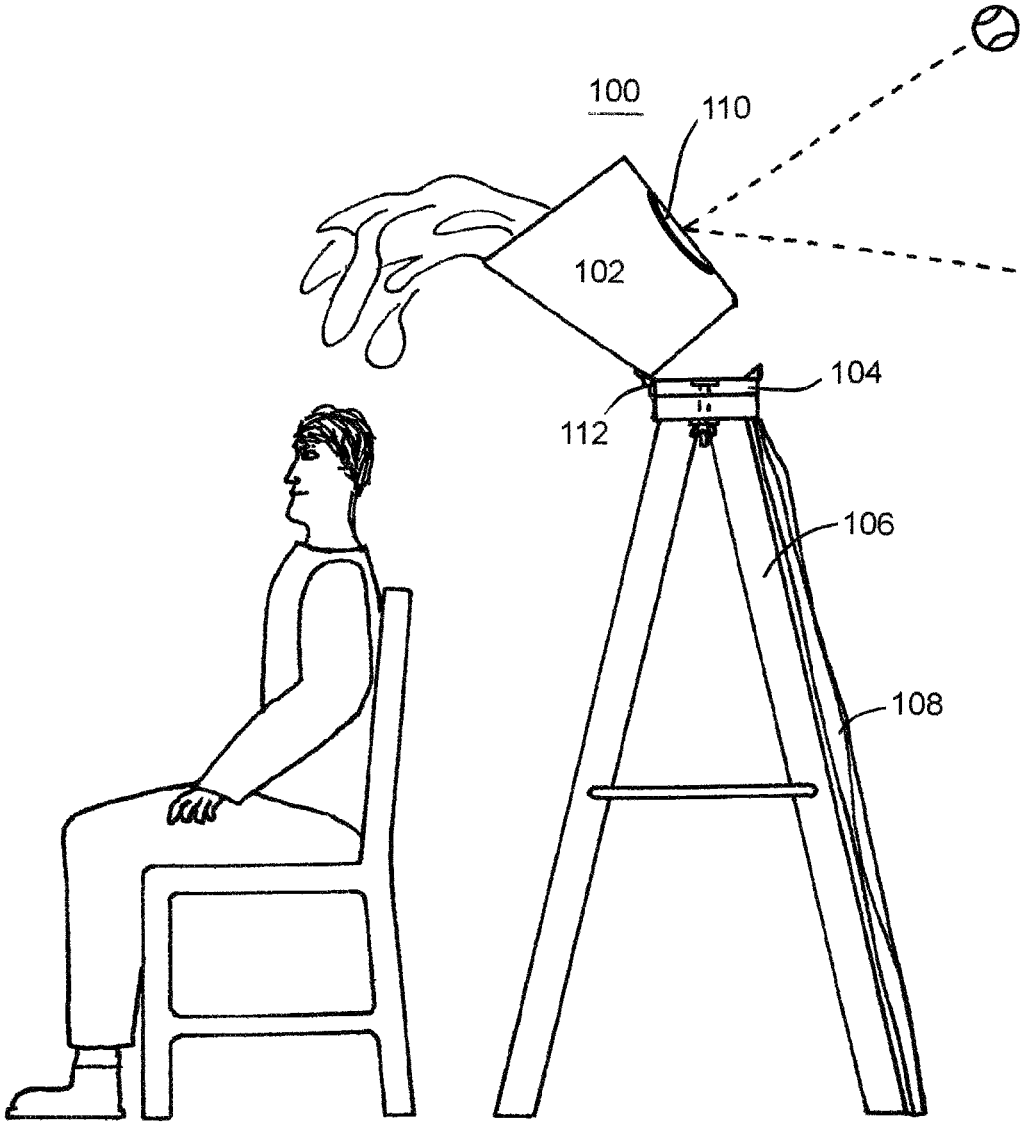
FIG. 1 is a side perspective view of an embodiment of a water dumping apparatus consistent with the principles of the invention attached with a ladder and having a subject dousee positioned adjacent and below the water container wherein a projectile has struck the target causing the bucket to rotate backwards on the hinge dumping water on the subject dousee.

FIG. 1 shows a water dumping apparatus constructed in accordance with and embodying the principles of the present invention in use as part of a water dousing game. As shown, the water dumping apparatus (100) comprises an open top container (102) holding water which container (102) is hingedly attached with a base (104) configured for attachment to a support apparatus (106) Mich, in this case, is a standard 6' step ladder. A subject dousee has been positioned in a chair directly behind the support apparatus (106), and adjacent and below the back side of the container (102). A shielding material (108) has been attached to the front side of the support apparatus to help prevent the subject dousee from being struck by a projectile. The force of a projectile, in this case a ball, striking a target (110) located on the front side of the container (102) has caused the container (102) to rotate backwards on the hinge axis (112) and dump water on the subject dousee.

The support apparatus (106) may be a standard 6' step ladder, as depicted in FIG. 1, or other standard with base. It should be sturdy and strong enough to hold the water dumping apparatus when containing water and stable enough to resist being tipped over when a projectile strikes it or the target, or when the force of the projectile hitting the target causes the water container (102) to rotate backward on the hinge axis. In a preferred embodiment, the support apparatus is a standard 6' step ladder because it is easy to position and is made to be sturdy and resist tipping over even when a heavy load is positioned at or near the top of the ladder. In an alternative embodiment, the support apparatus may be some other standard such as a pole mounted to base or an arch or beam mounted between supports as long as it is sturdy, resists tipping and has one or more portions or members which would allow the water dousing apparatus to be attached easily thereto and above the level of a standard chair. A standard 6' utility ladder is preferable for a variety of reasons. Such ladders are sturdy, readily available and easy to set up and take down. The ladder may be positioned such that the steps face forward in the direction of the douser and the rear portion is immediately adjacent to the dousee seated in the chair. By positioning the ladder in this orientation, the steps provide extra material strength to guard against a projectile directly striking the subject dousee. The steps portion also rise at a lower angle relative to the ground than the opposing support portion. A projectile striking the steps portion would be deflected upward decreasing the force of the impact and decreasing the likelihood of the ladder tipping over at impact. The rear facing portion rises at substantially 90 degrees. Thus, the subject dousee may be easily positioned in a chair immediately adjacent the rear portion and substantially below the water container. The obvious benefit of using a standard ladder as the support apparatus is that it is a common household item and does not have to be sold as part of the overall water game system. An additional benefit is that most standard ladders have holes in the top horizontal support allowing for attachment means (such as a bolt or other standard attachment means) to be threaded through the holes and utilize to readily and easily and securely attach the water dumping apparatus with the support.

Also shown in FIG. 1, shielding material (108), preferably made of an elastic mesh material, may be mounted on the support apparatus (in this case to the steps portion of the ladder positioned most closely to the participants throwing or hitting projectiles at the target) to shield the subject dousee from being inadvertently struck by a projectile otherwise aimed at the target. It is preferable for the shielding material to be an elastic mesh material (such as that used with ordinary expandable laundry bags) because it is light and strong and easy to manufacture and ship. The elasticity of the material also provides safety benefits in that it will dissipate the force of the projectile thus ensuring that the force of the projectile will not cause the ladder and attached dumping apparatus (100) to fall over. Other shielding materials (such as cardboard, plastic sheeting, canvas tarp or other materials that are light, strong and easily folded and shipped) may be utilized for the same purpose. Shielding material may contain writing, logos or information pertaining to the game.

Figure 2:
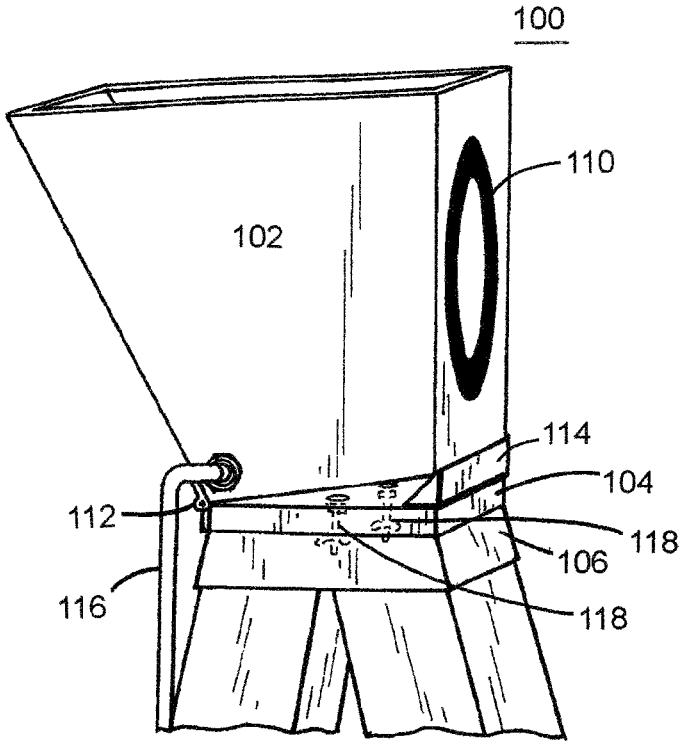
FIG. 2 is a side perspective view of an embodiment of a water dumping apparatus consistent with the principles of the invention having a water container hingedly attached with a base portion and in closed (or ready) position.

FIG. 2 shows a perspective side view of the water dumping apparatus (100) including target (110), water container (102), hinge connection with axis (112), base (104), wedge (114) for adjusting the tipping point of the water container, tube (116) for assisting in filling the water container, and means for attaching the dousing apparatus to the support apparatus which in this case are two bolts with fly nuts (118). In the preferred embodiment as shown, the target (110) is painted on or otherwise contiguous with the water container. In alternative embodiments, the target may be part of or attached to a member that is attached with the container. In this example, the water container (102) is made of molded plastic or other strong, light and durable material which will hold water but is unlikely to break or shatter as a result of being struck by a projectile.

The embodiment of the container (102) shown in FIG. 2 is somewhat rectangular having a front side containing a target, an extending back (or rear facing) side opposite the front side, opposing right and left sides, an open top portion and a bottom portion. This configuration is most helpful for purposes of description. However, it should be understood that alternative embodiments of the container may have rounded edges or be substantially cylindrical or fashioned to look like thematic shapes (such as a large watering can). Thus, it may be helpful to describe that portion of the container located adjacent to the nexus between bottom and front sides and the bottom front portion, the portion of the container located adjacent to the nexus between the bottom and back sides as the bottom rear portion, that portion of the container nearer the back side and the open top as the top rear portion and so on. Generally, that portion of the container positioned closest to the douser is considered the front portion and that portion positioned closest to the dousee is the back or "rear" portion. The target (110) is positioned on or near the front side or portion of the container. In the embodiment shown, the target (110) consists of painted circles. Other types of indicators may be used as the target such as squares or other indicia. Alternatively, a separate member may be attached with the front or opposing sides of the water container, or may be mounted to a member that extends above the container. Regardless of the location of the target, it should be attached such that the force of a projectile squarely striking the target will cause the container to rotate backward to spill the contents on the dousee. This includes a target member that is larger than the target shown and which may be utilized to increase the size, height or position of the target relative to the front portion of the water container.

In a preferred embodiment, the water container (102) is made of a light, durable moldable material such as plastic or vinyl which can be easily configured to hold water. In a preferred embodiment, the front side of the container rises approximately vertical from the bottom and serves as the target. The opposite back or rear facing side (i.e. that side positioned to face the subject dousee seated in the chair below, rises at an angle upwards and away from the center of the bottom portion. This angled rear facing side serves as a pouring side which directs the water away from the support apparatus and toward the dousee when the container is rotated. The angled rear side also serves to shift the center of gravity of the container when filled with water. The more water filling the container, the more water will be positioned toward the back side of the container such that less force is needed to cause the water container to tip backward when struck from the front side with a projectile. This is particularly helpful when the water container is full. The other sides of the water container may be rounded or substantially straight and vertical. In an alternative embodiment, a typically cylindrical bucket shape may be utilized as the water container. As previously stated, the front facing portion may serve as the target or a separate target member may be attached therewith. The rear facing portion may include a molded pouring spout such as those typically used for house cleaning or other utility purposes. Alternatively, the water container may be shaped in the form of something identified with the game such as a likeness (face, caricature, or shape etc.). For example, the container might be shaped as an oversized watering can with spout facing backwards toward the dousee and flattened target side facing the douser.

The embodiment of FIG. 2 shows the water container (102) is hingedly attached with the base (104). The hinge attachment may include opposing hinge flanges with pivot point, described herein as a hinge axis 112. Alternatively, the bottom of the container 102 and the rear side or top of the base (104) may make up the flanges. As shown, one hinge flange is attached to the back bottom side of the container (102) and the opposing hinge flange is located on the rear facing side of the base (104). The hinge axis (112) is located outside the intersection between the back side of the container and the rear side of the base. This configuration is helpful in allowing the hinge to move from closed position (FIG. 2) to open position (FIG. 3) without the base impeding the rotation of the container. However, in alternative configuration, the hinge axis can be located other locations between the bottom of the container and the top of the base as long as there is enough space to allow the hinge to open and the container to rotate backward spilling the contents backward and down upon the dousee. An alternative embodiment of the configuration shown in FIG. 2 might have a portion of the water container molded to include one flange portion of a hinge with curled tabs which when combined with an opposing tabbed portion (possibly part of or contiguous with the base) will allow a pin to be inserted therein forming a working hinge axis. Again, in the preferred embodiment shown in FIG. 2, the hinge axis (112) is located outside the back side of the water container to make it easier for the container to rotate backward when the target is struck. In alternative embodiments, the hinge connection may moveably adjustable relative to the base portion to allow the hinge axis (112) to be adjusted relative to the bottom of the container. This would assist in allowing the tipping point of the container to be adjusted to make it easier or more difficult (i.e. less or more force required) to tip the container when it is filled.

In the preferred embodiment, the base 104 is made of moldable, strong and durable material that can be easily mounted with a support apparatus using attachment means such as nuts/bolts or other hardware generally known in the industry. For example, the base may be made of wood, plastic, vinyl, rubber that is light, strong and durable and otherwise appropriate for use. As stated above, the base may include or be attached with a hinge portion that, when combined with the preferred opposing water container hinge portion, may form a working hinge with pin inserted therein to form the hinge axis (112).

Figure 3:
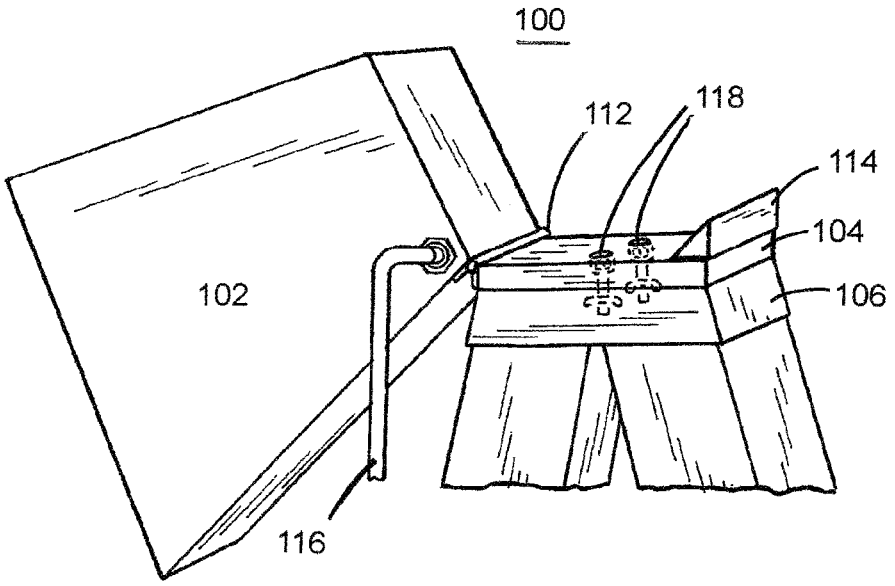
FIG. 3 is a side perspective view of an embodiment of a water dumping apparatus consistent with the principles of the invention having a water container hingedly attached with a base portion and in open position wherein the water container has rotated backward on the hinge axis to release water onto the subject below.

It is preferable that any attachment of the base with the support apparatus be solid and secure to prevent the apparatus from falling from or being dislodged from the support apparatus during use. As shown in FIG. 2, the base is attachable to the support apparatus using attachment means. FIGS. 2 and 3 shows an embodiment of the attachment means for attaching the base to the top portion of a ladder consisting of a bolt and fly nut mechanism whereby the bolt is threaded through the base and top horizontal member of the ladder and tightened from below. This configuration is preferable when the support apparatus is a standard step ladder having holes in the horizontal support (as many of them do for purpose of attaching other utility items). Most standard step ladders have horizontal top members that are roughly 13" wide and at least "7 deep. Holes for purposes of attaching paint trays and other standard attachments are generally located adjacent to the sides roughly 1" from the edge. Use of these holes for attaching the base to the support means is convenient, however the holes in the support member generally vary somewhat and, for this reason, the holes in the base are preferably oblong to allow for some adjustment when needed. Further, the base used for purposes of attachment with a step ladder using these holes should be wider than the approximately 13" wide horizontal support member (i.e. top of the ladder) so that holes may be positioned in the base to allow attachment without compromising the strength and integrity of the base. Alternatively, other known means for attachment including by not limited to bolts threaded from top or bottom, clamps, straps, screws or other means known in the art may be used to attach the base to the support apparatus.

Looking at FIG. 2, one will note means for filling the water container with water in the form of a tube (116) which extends from the back lower portion of the water container downward toward the floor. The tube (116) is preferably made of a flexible material suitable for use with water including lightweight plastic, vinyl, rubber or other similar materials used as water containing tubes having connection hardware suitable for attachment with a water container at one end and attachment with a standard garden hose at the other. The purpose is to easily allow a user to fill the water container by attaching a garden hose to it rather than having to fill the container from the top which might be cumbersome and time consuming. A (not shown) valve may be positioned on the tube to allow the user to open and close the tube. This allows the user to turn the hose on at the bib and to fill the water container by simply opening the valve and allowing water to fill the container (utilizing the water pressure from the hose) and to prevent water from flowing back out of the container once the container is filled as desired. This saves considerable time and effort for the user in filling the water container between douses. A lightweight tube is utilized for attachment with the water container rather than simply attaching a garden hose directly with the water container. This is because the weight of the garden hose (and water therein) may substantially destabilize the apparatus or otherwise inhibit the water container from rotating when the target is struck. Thus, a preferred embodiment utilizes a tube which runs from the container all the way to the ground where it is configured for connection with a garden hose at the opposite end. At the connection with the container, the tube (116) is configured to swivel at the point of connection to allow the container to rotate unimpeded by the tube. In this way, the tube will remain in the same position (i.e. substantially vertical) while the water container rotates backward to dump water on the dousee. As shown by looking at FIG. 2 (showing the closed, or "ready" position) and FIG. 3 (showing the open, or "rotated" position), the connected tube (116) remains substantially vertical when the container rotates backwards. In a preferred embodiment the tube swivels at the connection with the water container by employing a gasket that allows the tube to turn but otherwise prevents water from seeping out of the hole. Other methods, such as use of a swivel adapter, may be used as an alternative to allow the water container to rotate when connected. In the preferred embodiment, the tube (116) extends down far enough from its connection with the container to allow a garden hose to be connected with the tube at the opposing end along the ground to substantially reduce the effect the weight of the garden hose might have on the stability of the support apparatus or the ability of the container to rotate backward when the target is struck.

One will note looking at FIGS. 2 and 3 that a wedge (114) is inserted between the bottom of the water container and the base to assist in adjusting the tipping point such that the water container will tip at the hinge when the target is struck. A wedge is easily adjustable and may be positioned so that the bottom of the water container rests higher in position on the wedge that it would otherwise without the wedge and making it adjustably easier to tip the container. The wedge may be of a standard 1" tall×3" wide with an angled edge. Alternatively, it may be a standard block. It may be made out of a light durable and strong foam, plastic, vinyl, rubber or other suitable material that will hold up after multiple uses and is soft and light enough to reduce the risk that it might injure the subject dousee if, for any reason, it falls away from the support apparatus when the target is struck and the water container tipped. It is preferable that the wedge be tethered (not shown) to the base to allow it to fall without getting lost or otherwise striking the subject below.

Figure 4A:
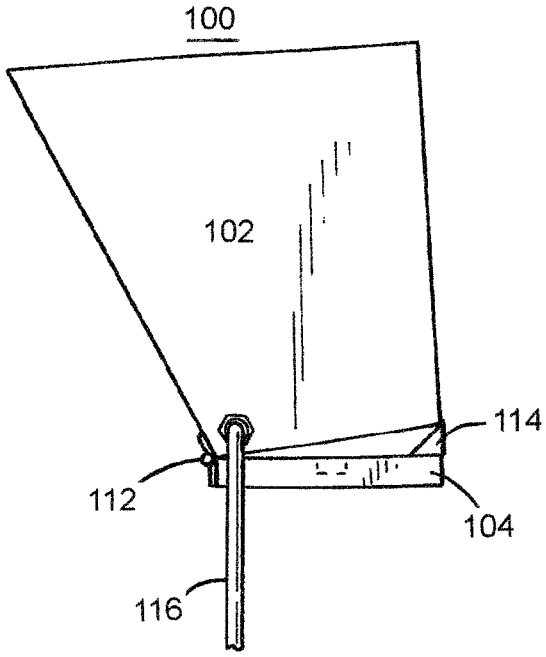
FIG. 4A is a side view of an embodiment of a water dumping apparatus consistent with the principles of the invention in a closed (or ready) position wherein a wedge is positioned between the water container and base to adjust the balance point of the container thus altering the required force of the projectile needed to cause the container to rotate backward on the hinge axis when the target is struck.
Figure 4B:
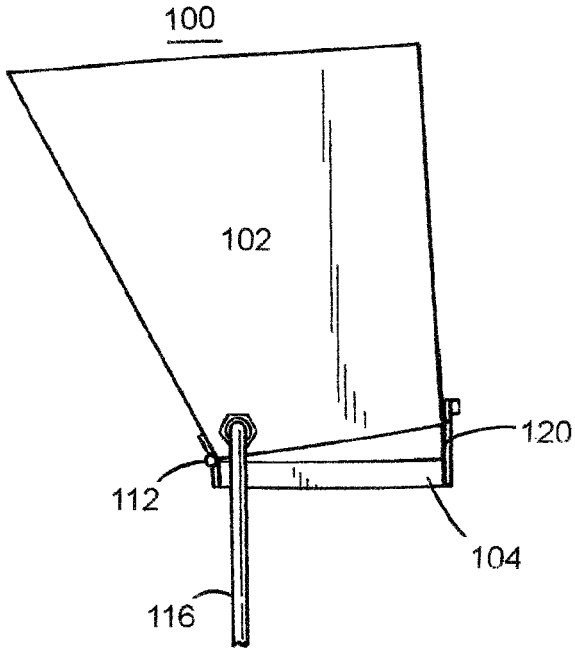
FIG. 4B is a side view of an embodiment of a water dumping apparatus consistent with the principles of the invention in closed (or ready) position wherein the water container is configured with an adjustable stand enabling the user to adjust the balance point of the container thus altering the required force of the projectile needed to cause the container to rotate backward on the hinge axis when the target is struck.

FIGS. 4A and 4B shows alternative methods for adjusting the tipping point of the water container. FIG. 4A shows the use of a wedge (114) inserted at the gap between the bottom front side of the container and the front portion of the base. Alternatively, the wedge can be inserted toward the back between the bottom of container and the base, but it is preferable to insert it from the front for purposes of stability and because it is less likely to inhibit the rotation of the container when struck if it is inserted from the front. FIG. 4B shows the alternative use of an adjustable stand (120) that is attached with or otherwise made integral with the front bottom portion of the water container. The stand may have a locking mechanism so that, once adjusted, it will be stabilized and provide the appropriate strength for raising the bottom portion of the container from the base to make it adjustably easier for the container to tip once the target is struck. It may be made of plastic, metal, vinyl, rubber or other suitable material for maintaining strength. In an alternative embodiment (not shown) an adjustable stand may be mounted to the top of the base rather than the bottom portion of the water container. In an alternative embodiment, the stand (120) is mounted to one or more sides of the container extending down toward the base. Also, as previously described, the tipping point of the container may be adjusted by way of adjusting the axis of the hinge relative to the bottom of the water container or top of the base. This would require, as previously explained, utilizing a mechanism know in the art for sliding or adjustably positioning the hinge axis. The point of the wedge, stand, and/or hinge adjustment is to allow the user to fine tune the tipping point of the water container (in other words, adjustably determining how much force is required to tip the water container when the target is struck by a projectile). This allows for the water dumping apparatus to be used with a variety of participants (including small children) who may not be otherwise able to throw or hit a projectile with enough mass and velocity striking the target with enough force to cause a water container filled with water to rotate and douse the subject.

The invention also consists of steps comprising a method for setting up and using the water dumping apparatus (100) as part of a dousing game. The first step is to position the support apparatus at an appropriate distance away from the dousers orienting the support apparatus so that it is most stable. If the support apparatus is a standard ladder, the ladder steps will be oriented toward the dousers. The next step is to attach a shielding material to the support apparatus. The next step is to attach the dousing apparatus to the support apparatus using the attachment means located on the base. The next step is to attach a garden hose to the tube and fill the water container with water. The next step is to adjust the tipping point of the water container using a wedge or stand. The next step is to position the subject dousee in a chair positioned immediately adjacent to and behind the support apparatus. The next step is to allow the dousers to hit or throw projectiles at the target to cause the water container to tip when the target is struck and douse the subject dousee with water. While these steps are stated in the preferred order, there may be one or two steps that may be eliminated or the order slightly changed depending on the situation. For example, it is preferred though not entirely necessary (depending on the type of support apparatus used) for shielding material to be attached to the front of the support apparatus because the support apparatus may already provide enough protection of the dousee from being struck by a projectile. It may also be easier to position the subject dousee in the chair before filling the container with water though, for safety reasons, it is preferred that the water container be set up and possibly tested with water before seating the dousee.

It should be noted that the water dousing apparatus described above, though designed for use with water, may otherwise be used to dump other items on the subject dousee. For example, instead of filling the container with water, the container may be filled with ping pong balls, foam balls, gelatin, foam, flowers, or other light items that may be put into the container and which will not injure the subject dousee.

It should be noted that a variety of projectiles may be suitable for use with the water dousing apparatus including tennis balls, flying disks, foam balls, bean bags or other projectiles that are heavy enough to provide enough force at impact to tip the container but would otherwise not provide so much force at impact with the target, container or support apparatus as to cause the support apparatus and container to fall onto the subject dousee or otherwise injure the dousee if the dousee were inadvertently hit by a projectile otherwise aimed at the target.

It should be noted that the target may be integral with the water container (i.e. painted on the container) or may part of a separate member (arm or extension) connected with the container and which would cause the container to tip when the target is struck. In the preferred embodiment, as shown, the target is integral with the container because it is the most efficient from a manufacturing and use standpoint.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirement without departing from those principles. The appended claims are intended to cover and embrace any and all such modifications, with the limits only of the true purview, spirit and scope of the invention.

What is claimed is:

1. A water dumping apparatus comprising:

a base having a top, bottom, front side, back side and opposing right and left sides, configured for attachment with a generally vertical support apparatus;

an open top container configured to hold a dousing material and generally having front side, back side, bottom, and opposing side portions wherein the front side, back side, and opposing side portions of the container extend from the bottom of the container upward toward atop edge of the container, wherein in a closed position the front side and opposing side portions of the container rise approximately vertically from the bottom of the container upward toward the top edge, wherein the back side of the container rises substantially outward and upward from the bottom of the container toward the top edge such that the top edge at the back side of the container extends further outward and away from the bottom of the container than the top edge at the front side and opposing sides of the container, and wherein the bottom of the container is attached with the base by a hinged connection such that the container may be rotated backward on the hinged connection from the closed position to an open position, wherein in the closed position the container is positioned substantially upright and over the base and in the open position the container is rotated backward on the hinged connection to release the dousing material from the open top, a target connected with the front side of the container, a mechanism for adjusting a tipping point of the container, and a tube connected at one end with the container by a swivel connector at a lower portion of one of the opposing side portions of the container substantially adjacent to the back side of the container and extending downward in a substantially vertical direction, the tube being configured for connecting at the opposite end with a standard garden hose and having an on/off valve, wherein the swivel connector allows the tube to swivel thus preventing the tube from inhibiting the rotation of the container from the closed position to the open position when the tube is connected at one end with the container and at the opposite end with a standard garden hose.

2. The apparatus of claim 1, wherein the dousing material is water.

3. The apparatus of claim 1, wherein in the closed position, the center of gravity of the container will adjust toward the back side of the container when the container is filled with dousing material.

4. The apparatus of claim 1, wherein the vertical support apparatus is a standard ladder having a horizontal top member with holes extending down through the horizontal top member.

5. The apparatus of claim 4 wherein the base is connected with the support apparatus using one or more bolt type fasteners extending from the top of the base through the bottom of the base and through correspondingly positioned holes located in the horizontal top member.

6. The apparatus of claim 4 wherein the base is connected with the support apparatus using a clamp type fastener.

7. The apparatus of claim 1 further comprising a shielding material configured for mounting to the support apparatus to assist in shielding a subject dousee from being hit by projectiles aimed at the target.

8. The apparatus of claim 1 wherein the target is painted on the front side of the container.

9. The apparatus of claim 1 wherein the target is connected with the front side of the container using an extending number.

10. The apparatus of claim 1 wherein the mechanism for adjusting the tipping point of the container is a wedge configured for insertion between the bottom of the container and the top of the base.

11. The apparatus of claim 1 wherein the mechanism for adjusting the tipping point of the container is an adjustable stand connected with the container.

12. The apparatus of claim 1 wherein the rotational axis of the hinged connection between the container and the base is located at a back top edge of the base.

13. The apparatus of claim 1 wherein the rotational axis of the hinged connection between the container and the base is located substantially toward a top back portion of the base.

14. The apparatus of claim 1, wherein the container is finable with water when the container is positioned upright relative to said base.

15. The apparatus of claim 1 wherein the mechanism for adjusting the tipping point of the container is a wedge inserted between the container and the base.

16. The apparatus of claim 1 wherein the mechanism for adjusting the tipping point of the container is an adjustable stand extending from the container to the base.

17. A method of using the water dumping apparatus of claim 1 comprising the following steps;

attaching the water dumping apparatus to a ladder;

attaching a protective shielding material to the ladder, positioning a subject dousee in a chair adjacent to and below a back side of a container;

filling the container with water utilizing a tube connected with the container, inserting a mechanism for adjusting a tipping point of the container between the bottom of the container and a base to adjust the tipping point of the container; and causing a projectile to strike a target located at a front side of the container with enough force to cause the container to rotate backward on a hinged connection and deposit water on the subject dousee.

* * * * *